United States Patent [19]

Sturhahn

[11] 4,195,470

[45] Apr. 1, 1980

[54] FALSE TWISTING APPARATUS

[75] Inventor: Hans Sturhahn, Esslingen, Fed. Rep. of Germany

[73] Assignee: Feldmuhle Aktiengesellschaft, Viersen, Fed. Rep. of Germany

[21] Appl. No.: 880,298

[22] Filed: Feb. 22, 1978

[30] Foreign Application Priority Data

Feb. 25, 1977 [DE] Fed. Rep. of Germany ..... 2708204

[51] Int. Cl.[2] ..... D02G 1/04; D01H 7/92

[52] U.S. Cl. ..... 57/339; 57/337; 57/338

[58] Field of Search ..... 57/77.4, 334, 337, 338, 57/339

[56] References Cited

U.S. PATENT DOCUMENTS

| | | | |
|---|---|---|---|
| 3,901,011 | 8/1975 | Schuster | 57/77.4 |
| 4,012,896 | 3/1977 | Fischbach | 57/77.4 |
| 4,018,041 | 4/1977 | Weigert et al. | 57/77.4 |
| 4,050,229 | 9/1977 | Hayahusa | 57/77.4 |
| 4,051,655 | 10/1977 | Lorenz et al. | 57/77.4 |

*Primary Examiner*—Donald Watkins

*Attorney, Agent, or Firm*—Toren, McGeady and Stanger

[57] ABSTRACT

In a false twisting apparatus in which the yarn to be twisted passes between parallel, rotating shafts carrying axially spaced friction disks which radially overlap disks on the other shafts, the yarn-engaging circumferential faces of the disks are surfaces of rotation about the shaft axes and arcuately connect respective radially extending, axially spaced end faces of the disks, each face having a yarn feed region and a yarn delivery region, the regions being annular about the axis of rotation and axially juxtaposed, the yarn feed region consisting essentially of aluminum, zirconium, or titanium oxide and having a surface roughness greater than the surface roughness of the yarn delivery region.

12 Claims, 8 Drawing Figures

FALSE TWISTING APPARATUS

Figure 1:
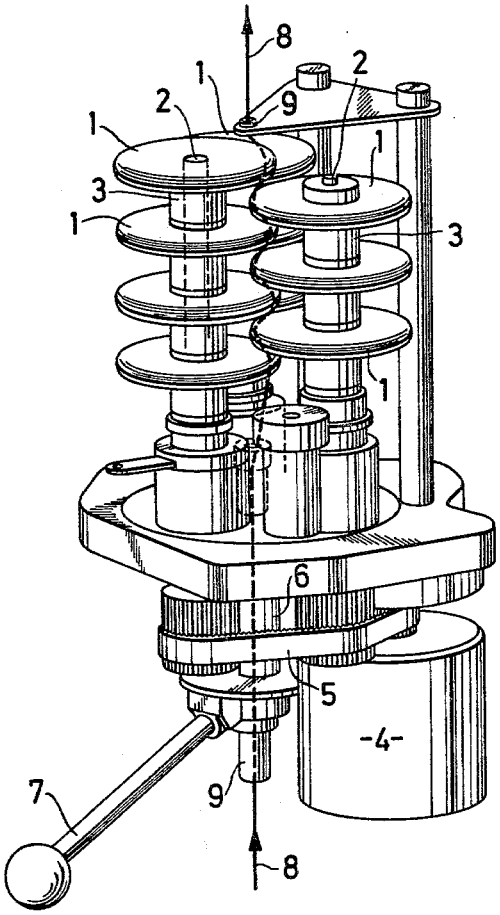

The invention relates to false twisting apparatus consisting of several shafts arranged parallel to each other and friction disks arranged thereon in radially overlapping relationship.

False twisting apparatus as such is known and described, for example, in German Patent Document No. 2,345,128. Further data are found in the literature in "Chemiefasern/TextilIndustrie" (Synthetic fibers/Textile Industry), October 1975, under the title "Improved Friction Texturing Process." Other publications deal with friction bushings that is, spindles with inner friction surfaces. The latter, however, are not subject matter of the present invention which relates exclusively to external friction with friction disks.

Yarns are textured in these units by contact of the yarn with the circumference of a rotating friction disk. The friction disks generally are arranged on upright shafts which stand at the apex points of an equilateral triangle and whose relative spacing can be adjusted. Each of these shafts carries friction disks axially separated by spacer bushings. The friction disks on adjacent shafts are axially offset and radially overlap each other so that the thread or yarn passing between the disks is deflected many times. The coefficient of friction between the yarn and the frictional material depends on a multitude of factors. Its value is affected not only by the employed material as such, that is, the yarn material and the material of the friction disk, but also the yarn tension, the thermoplasticity of the yarn, vibrations, and, to a very important extent, the surface roughness of the friction disks. All these factors affect the receptivity for dyes and the tensile strength, and cause differences in the curliness, the hand, and in the bulk. A finishing overlay has an additional significant influence, both as to its composition and as to the uniformity of its application.

It is understandable that the expert aims at eliminating at least a few of this multiplicity of variables in order to arrive at constant, reproducible twist values. In order to keep the frictional properties of friction disks as constant as possible, the use of polyurethane has been discontinued in many instances, and disks of metal having flame sprayed surfaces or of metal with inserted diamond grains are employed. It is also known to employ ceramic disks, or metal disks having a flame-sprayed, ceramic coating. Whereas the pure metal disks had too high wear losses and therefore continuously varying frictional properties, a statement valid also for the polyurethane disks, the flame-sprayed surfaces of friction disks, particularly those flame-sprayed with a ceramic coating, have so high a porosity that excessive damage to the yarn occurred, and deposits of yarn and finishing material were built up on these disks.

Commercial ceramic material was unsuited because of its high susceptibility to breakage and sensitivity to shock and impact. It also did not tolerate the necessary high rotary speeds. Rotary speeds, which may be of the order of 14,000 r.p.m., exceed the tensile strength of the usual ceramic materials at the outer diameter of the friction disks even when they have only a relatively small diameter. Additionally, high operational safety and freedom from accidents are required especially in these fast turning units.

Aside from the material of the friction disk, the coefficient of friction is substantially influenced by the surface roughness. On the one hand, a certain surface roughness should be present in order to achieve any twist at all; on the other hand, the yarn is to be treated very carefully in order not to damage the fibers whereby lint is generated by abrasion. However, abrasion of the fibers occurs in all units known so far, that is, the fibers are damaged in all cases in certain areas. Therefore, it is the object of the present invention to reduce this fiber damage by false twisting apparatus as far as possible and to provide friction disks which show constant friction values between yarn and friction disk over a substantial service life, that is, maintain their surface roughness in the range originally selected.

This object is achieved by false twisting apparatus consisting of several shafts arranged parallel to each other on which overlapping friction disks are located and having the characterizing feature that the friction disks consist of ceramic oxide material of high purity at least in the region of yarn feed, and that the friction surfaces in the regions of yarn feed have greater surface roughness than in the region of yarn delivery.

By the use of high-purity ceramic oxides in the yarn feed region, there is achieved a defined friction between the friction surface and the yarn which does not change over the long service life of the ceramic material. It is neither impaired by abrasion because the ceramic oxide material is extremely wear resistant, nor by a build-up of finishing materials or pigments which cannot gain a foothold on the dense ceramic oxide material.

However, the difference in surface roughness between the region of yarn feed and the region of yarn delivery of the friction surfaces is of decisive importance. The contact surface in the region of yarn feed produces the drill, and thus serves to texture the yarn. Twisting friction in the region of yarn delivery, however, is undesirable and merely causes wear, that is, frictional abrasion from the yarn. It has already been proposed to avoid such abrasion losses by providing the friction disk peripheries instead of with a semi-circular section with that of a quarter circle, that is, to make thin disks which merely provide a feed region for the yarn. The yarn necessarily is deflected in this case by being led about an edge of about 90 degrees which causes severe fiber damage because of high pulling work. The present invention makes it possible to lead the yarn practically in an arc of 180° and still to expose it to friction forces only in the feed region of the friction surface because the delivery surface has substantially lower surface roughness, and lower coefficients of friction are effective in the region of yarn delivery.

Such an arrangement of the friction surfaces is possible only by the use of sintered, ceramic oxide materials of high purity, at least in the region of yarn feed, because only in this material the wear is so small that the surface roughness initially selected is maintained, that is, that no change in the surface is caused by the yarn. Polishing, as caused by the running yarn in other materials, is not harmful in the region of yarn delivery so that, in accordance with a preferred embodiment of the invention, the friction disks may be constructed as ceramic-metal compound disks, the friction surface in the region of yarn feed consisting of sintered, ceramic oxide material, and the friction surface in the region of yarn delivery consisting of metal, particularly of light metal.

According to a particularly preferred embodiment of the invention, the surface roughness Ra of the friction surface in the region of yarn feed is between 0.3 μm and 1.5 μm, and in the region of yarn delivery between 0.05 μm and 0.25 μm. Preferably the surface roughness of the friction surface of the yarn feed is at Ra>0.8 μm, and in the region of yarn delivery, that is, the polished part of the friction disk, the roughness value Ra is preferably between 0.1 and 0.15 μm. Because of this combination of roughness values, twist is imparted to the yarn with utmost care and thus practically without abrasion.

The term "sintered ceramic material" as referred to in the preceding discussion embraces essentially the sintered oxides of zirconium, titanium, and particularly aluminum, as well as their mixtures. They must be of high purity in order to withstand stresses. According to a particularly preferred embodiment of the invention, the friction disk consists of sintered aluminum oxide having a density equal to or greater than 3.92 g/cm$^3$,
a porosity equal to or smaller than 2%,
a water absorption equal to or smaller than 0.01%,
a purity equal to or greater than 99.7% $Al_2O_3$.
a Vickers hardness (P=2M) equal to or greater than 22,000 N/mm$^2$,
an average grain size equal to or smaller than 10 μm,
an average bending strength equal to or greater than 320 N/mm$^2$,
a compressive strength equal to or greater than 4,000 N/mm$^2$,
a tensile strength equal to or greater than 160 N/mm$^2$.

Such material ensures a long service life of friction disks without any changes of the friction surface over years, the superior running properties being achieved especially by the combination of high density with low average grain size and high purity of the sintered aluminum oxide. As to "purity," it is to be understood that the fewest possible foreign materials should be present in the aluminum oxide as additional components which may cause the formation of a glassy interphase or transition phase. This requirement is not incompatible with the admixture of certain addition agents to the starting powder, that is, the aluminum oxide, such as magnesium oxide as a grain growth inhibitor, as it is also possible intentionally to add traces of coloring substances, for example chromium oxide in order to make the yarn running over the friction disk more clearly visible by coloring the disk.

According to a very advantageous embodiment of the invention, the friction disks are of asymmetrical construction. The term "asymmetrical" will be understood to mean that the edge curvature of the disk is defined in an axial section not only by one radius, but by two or more radii of curvature and, optionally, also by straight lines. It is particularly advantageous that the section of the friction area in the region of yarn feed embrace an arc of 30 to 140 degrees, this arc again being defined by several radii. Analogous conditions apply to the friction area in the region of yarn delivery, where the arc should encompass 20 to 110 degrees. In a particularly preferred design, the disk contour in the yarn feed region is defined by a straight line extending at a small acute angle to the radial end face of the friction disk, to which is joined an arc of a relatively small radius of a magnitude amounting to about 30% to 50% of the disk thickness. The first arc so formed is followed by a second arc whose radius of curvature amounts to 80% to 90% of the disk thickness, a total angle of 50 to 130 degrees being covered by these two arcs, and the contour formed by these two arcs is joined by a third arc extending to the other radial end face of the friction disk and having a radius of curvature amounting to 10 to 25% of the disk thickness. This last-mentioned arc embraces an angle of about 40 to 90 degrees and also corresponds to the length for friction area of the yarn delivery. Optionally, a short straight line may join the third arc and merge with the other radial end face of the friction disk at an obtuse angle. This straight line then also defines a part of the friction area of the yarn delivery.

Instead of the described complicated contour of the asymmetrical disk by means of which particularly good results are achieved, it is possible of course, to employ friction disks whose contours have only one radius of curvature if only the essential conditions are maintained, that is, that the friction areas in the region of yarn feed extend in an arc of at least 30 to at most 140 degrees and a corresponding arc of 20 to 110 degrees in the frictional region of yarn delivery.

An embodiment of the invention in which the friction disks are ceramic/metal compound disks has substantial importance, the friction area in the region of yarn feed consisting of sintered ceramic oxide material, and the friction area in the region of yarn delivery consisting of metal. The two materials are preferably joined by cementing, a very simple manipulative step, but may also be joined by soldering or even welding. The two last-mentioned alternatives in all cases result in a substantially stronger bond between metal and ceramic oxide material, but are substantially more costly so that they are not preferred for this reason.

It is a further advantage that metal, as compared to ceramic material, has substantially higher tensile strength. The overall tensile strength of the friction disk is thus increased by the intimate bond of metal and ceramic material, that is, the disk may turn at substantially higher rotary speed without risk of bursting. It consists preferably of two plates cemented to each other in area contact, the plate on the side of yarn feed consisting of ceramic oxide material, and the plate on the side of yarn delivery of metal, particularly light metal. The use of light metal provides the additional advantage of reducing the weight of the friction disk, that is, a reduction of centrifugal forces and thereby a reduction in the stresses in the shafts and in the required tensile strength of the material of the friction disk.

In addition to the possibility of constructing the friction disk from a ceramic/metal compound disk in which the two components of metal and ceramic oxide are joined undetachably to each other, it is proposed according to a further embodiment of the invention, to assemble the ceramic/metal compound disk from individual elements held together only by pressure, the metal unit constituting a spacer which keeps one disk at a distance from another disk on the same shaft, and also receives and envelops the associated ceramic component by external centering. The connection between metal and ceramic oxide material may be releasable in this instance, that is, the metal element being fitted on the ceramic piece over a portion of the disk thickness which offers the advantage of permitting different distances between individual ceramic disks to be set by replacing the spacers. Here too, it is possible to provide a fixed, undetachable connection by soldering, welding, or cementing.

It is a further advantage of making the spacers integral with the hubs of the compound disk that protection against winding is achieved by these hubs.

The invention will be described below with reference to the drawings.

FIG. 1 shows false twisting apparatus of the invention having friction disks arranged on shafts in perspective representation; and FIGS. 2 to 8 show different friction disks of the invention associated yarns in fragmentary elevational section, through the axis of rotation.

Three or four friction disks 1 are arranged on each of three upright shafts 2 which are offset from each other relative to a parallel, central line of reference at angles of 120 degrees. The axial spacing of the friction disks 1 on each shaft is fixed by spacers 3. The shafts are driven by a motor 4 and a cog belt 5. The shafts 2 may be adjusted relative to each other by an eccentric 6 which is operated by a lever 7 so that the yarn 8, guided through bushings 9, may be introduced along the aforementioned reference line.

Figure 2:
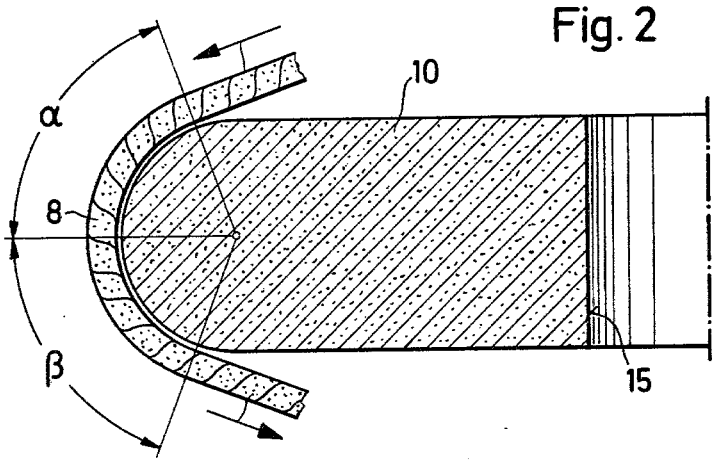
Figure 3:
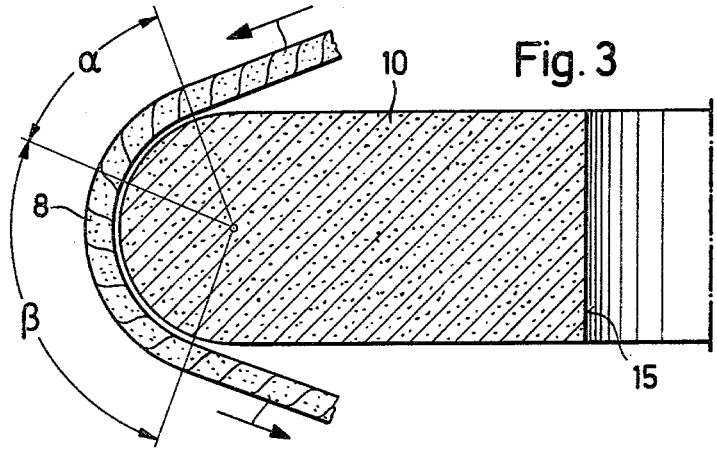
Figure 6:
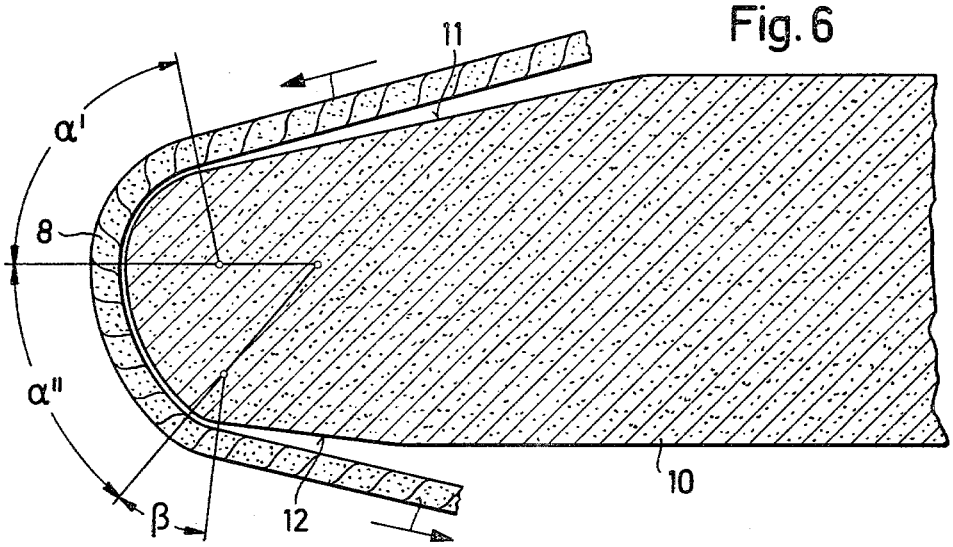

The friction disks of FIGS. 2, 3, and 6 are plates 10 of high-purity, sintered aluminum oxide. They have thicknesses of 3 to 7 millimeters and differ in the cross sections of their outer circumferences or friction areas. Each friction area is a surface of rotation. In the symmetrical friction disk of FIG. 2, the rougher region of feed for the yarn 8 join the smoother region for delivery of the yarn 8 where the median, radial plane of symmetry of the plate 10 intersects the curved circumference. The yarn 8 envelops the friction disk 1 in the feed region along a surface of rotation defined by the arc over an angle $\alpha$, and in the delivery region along a surface of rotation defined by the arc over an angle $\beta$ equal to $\alpha$, the two arcs having a common center of curvature in the plane of symmetry. The roughness Ra in the region of the angle $\alpha$ is between 0.3 and 1.5 $\mu$m, preferably 0.5 to 0.6 $\mu$m; whereas the surface roughness in the region of the angle $\beta$ is at Ra=0.05 to 0.25, preferably between 0.1 and 0.15 $\mu$m. The area over angle $\beta$ thus is polished.

In the disk of FIG. 3 differs from that of FIG. 2 by different magnitudes of the angles $\alpha$ and $\beta$, the rough feed region defined by the angle $\alpha$ being narrower than the smoother delivery region defined by the angle $\beta$.

In the asymmetrical friction disk shown in FIG. 6, the friction area is defined not only by arcs but also by portions of straight lines, a yarn feed line 11 and a yarn delivery line 12. Furthermore, the contour of the friction disk is composed in the edge region of several arcs of different radius of curvature as described above. Thus, the arcs over angles $\alpha 1$ and $\alpha 2$ at least partly define the feed region having high roughness, to which depending on the position of the shafts 2, the yarn feed line 11 may add a portion of the contour effective for twisting the yarn 8. The polished region is defined by the angle $\beta$. Here again, when the shafts 2 are closely positioned, an additional portion of the polished region is defined by the yarn delivery line 12, this time however, in the polished region of the friction disk 1.

Figure 4:
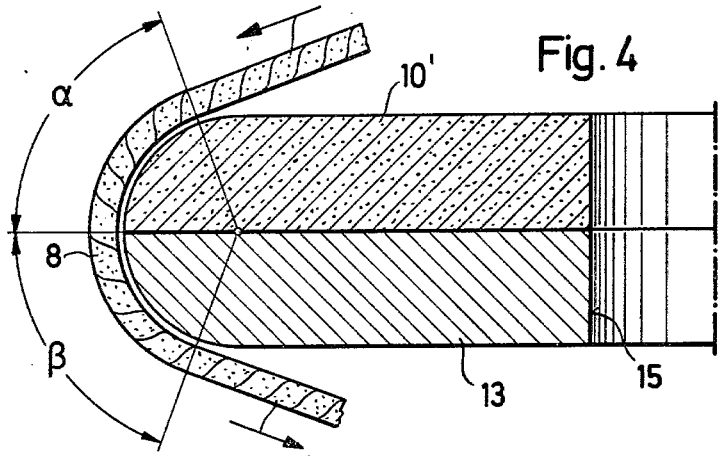
Figure 7:
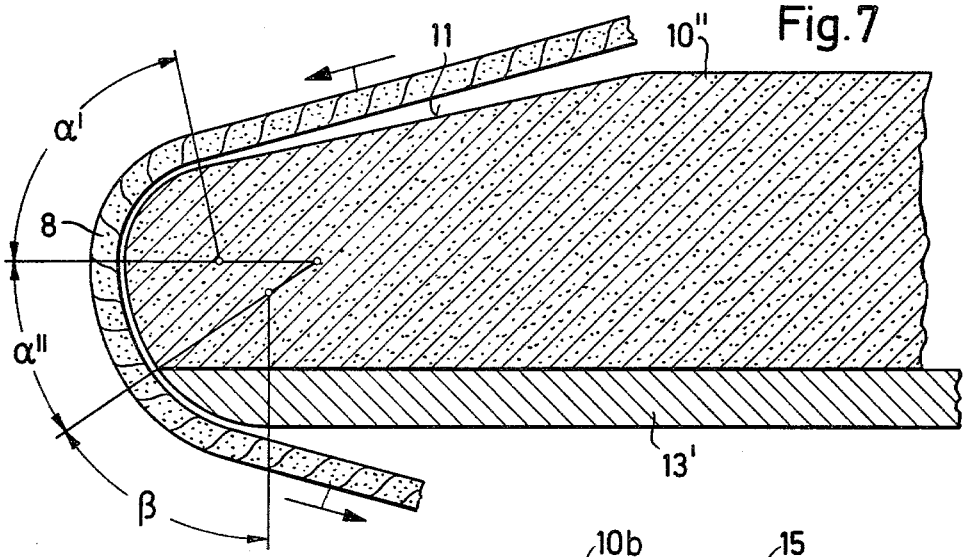

The friction disks illustrated in FIGS. 4 and 7 are metal/ceramic compound structures consisting of a ceramic plate 10', 10 and a metal plate 13, 13' which are joined in area contact along a planar surface radial relative to the axis of rotation and separating the feed and delivery areas of the circumference. The disk of FIG. 4 is otherwise identical with that described with reference to FIG. 2. The disk of FIG. 7 differs in contour from that of FIG. 6, by differences in magnitude of the respective angles $\alpha''$ and $\beta$, and by the absense of a straight delivery line.

Figure 5:
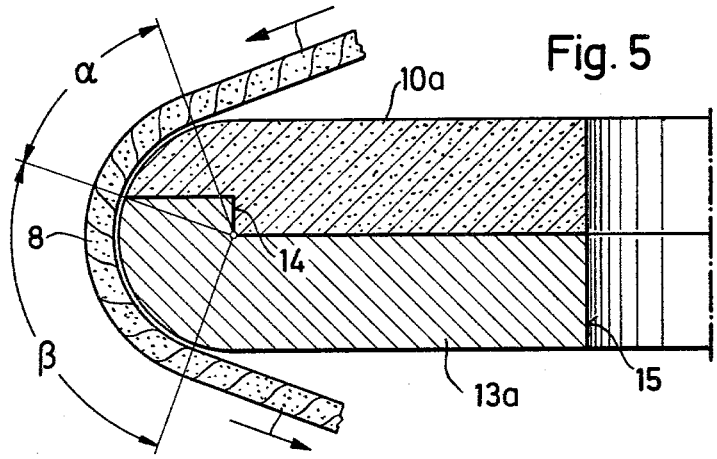
Figure 8:
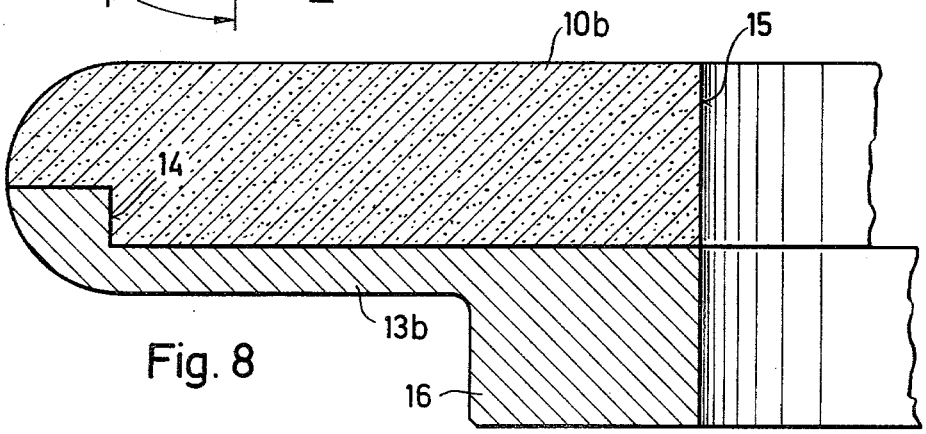

In the disks shown in FIGS. 5 and 8, the metal elements **13*a*, 13*b* are formed with central recesses in respective radial faces in which central projections 14, 14' of the associated ceramic plates 10*a*, 10*b* are received so that the ceramic plates are centered by radial, clamping engagement by the metal elements. The bore 15 in each friction disk is selected for receiving one of the shafts 2 with a sliding fit. The disks of FIGS. 2 and 7 are separated from each other by the spacers 3 and clamped to each other on the shaft 2 so that they can turn only jointly with the shaft 2** after assembly.

Instead of spacers 2 which are used preferably with friction disks consisting entirely of ceramic material, the metal element **13*b* is provided with a hub 16 which assumes the function of the spacer 3 for the ceramic/-metal compound structure shown in FIG. 8**.

What is claimed is

1. In false twisting apparatus including a plurality of shafts, drive means for rotating said shafts about respective, radially spaced axes extending in a common direction, a plurality of friction disks mounted on said shafts in axially spaced relationship, the disks on each shaft radially overlapping the disks on each other shaft, and guide means for guiding a yarn to be twisted axially between said shafts for sequential frictional engagement by the circumferential faces of said disks, said faces being surfaces of rotation about said axes and arcuately connecting respective radially extending, axially spaced end faces of said disks, the improvement which comprises:

(a) each of said faces consisting of a yarn feed region and a yarn delivery region, (b) said regions being annular about said axis and axially juxtaposed, (c) said disk consisting essentially of at least one oxide of aluminum, zirconium, or titanium, and said yarn feed region having a surface roughness greater than the surface roughness of said yarn delivery region.

2. In apparatus according to claim 1 said yarn feed region being between 0.3 $\mu$m and 1.5 $\mu$m.

3. In apparatus according to claim 2, said yarn delivery region being between 0.05 $\mu$m and 0.25 $\mu$m.

4. In apparatus as set forth in claim 1, the axial width of said yarn feed region being different from the axial width of said yarn delivery region.

5. In apparatus as set forth in claim 4, said circumference being defined in an axial section of said disk by first, second, and third sequentially merging arcs, said first arc having a radius of curvature equal to 20% to 50% of the axial spacing of said end faces, said second arc having a radius of curvature equal to 80% to 90% of said spacing, and said third arc having a radius of curvature equal to 10% to 25% of said spacing, said arcs bounding respective angles, the angles bounded by said first and second arcs jointly amounting to 50 to 130 degrees.

6. In apparatus as set forth in claim 5, the portion of said circumference defined by said first and second arcs constituting a portion of said yarn feed region, and the portion of said circumference defined by said third arc constituting a portion of said yarn delivery region.

7. In apparatus as set forth in claim 6, the angle bounded by said third arc amounting to 40 to 90 degrees.

8. In apparatus as set forth in claim 6, said circumference being further defined in at least one of said regions in said axial section by a straight line merging with one of said arcs and one of said end faces.

9. In apparatus as set forth in claim 1, said yarn delivery region consisting essentially of metal.

10. In apparatus as set forth in claim 1, said oxide being aluminum oxide.

11. In apparatus according to claim 10, said aluminum oxide having a density equal to or greater than 3.92 $g/cm^3$, a porosity equal to or smaller than 2%, a water absorption equal to or smaller than 0.01%, a Vickers hardness (P=2N) equal to or greater than 22,000 $N/mm^2$, an average grain size equal to or smaller than 10 $\mu m$, an average bending strength equal to or greater than 320 $N/mm^2$, a compressive strength equal to or greater than 4,000 $N/mm^2$, a tensile strength equal to or greater than 160 $N/mm^2$.

12. In apparatus as set forth in claim 1, said yarn feed region extending between said end faces in an arc of 30 to 140 degrees, and said yarn delivery region extending between said faces in an arc of 20 to 110 degrees.

* * * * *